US008403469B2

(12) United States Patent
Kondo et al.

(10) Patent No.: US 8,403,469 B2
(45) Date of Patent: Mar. 26, 2013

(54) PRINTING APPARATUS

(75) Inventors: Katsuyuki Kondo, Shiojiri (JP); Seiji Kawabata, Matsumoto (JP); Atsuki Sawata, Fanabashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/235,579

(22) Filed: Sep. 19, 2011

(65) Prior Publication Data

US 2012/0069106 A1 Mar. 22, 2012

(30) Foreign Application Priority Data

Sep. 21, 2010 (JP) ..... 2010-210520

(51) Int. Cl.
*B41J 2/175* (2006.01)
*B41J 2/01* (2006.01)

(52) U.S. Cl. ..... 347/86; 347/104

(58) Field of Classification Search ..... 347/86, 347/104

See application file for complete search history.

(56) References Cited

U.S. PATENT DOCUMENTS 7,686,446 B2 * 3/2010 King et al. ..... 347/108
7,800,788 B2 9/2010 Yazawa et al.

FOREIGN PATENT DOCUMENTS

JP 2006-205655 8/2006

* cited by examiner

*Primary Examiner* — Jannelle M Lebron

(57) ABSTRACT

A printing apparatus that is a vertical installation type apparatus having a height direction dimension that is larger than at least one of a width direction dimension and a length direction dimension when the printing apparatus is installed, includes an ink cartridge that can be attached to and detached from a printing apparatus body, and an attachment section to which the ink cartridge is attached. The ink cartridge can be attached to and detached from the attachment section from a top surface side of the printing apparatus. The thus-structured printing apparatus allows a user to easily reach the attachment section for the ink cartridge regardless of which face of the printing apparatus is facing the user.

5 Claims, 5 Drawing Sheets

PRINTING APPARATUS

CROSS-REFERENCE TO RELATED APPLICATION

Priority is claimed under 35 U.S.C. §119 to Japanese Application No. 2010-210520 filed on Sep. 21, 2010, which is hereby incorporated by reference in its entirety.

BACKGROUND

1. Technical Field

The present invention relates to a printing apparatus that includes an ink cartridge that is attachable to and detachable from a printing apparatus body, and an attachment section to which the ink cartridge is attached. Examples of the printing apparatus of the invention include an ink jet printer, a wire dot printer, a laser printer, a line printer, a copying machine, and a facsimile machine.

2. Related Art

In the related art, as disclosed in JP-A-2006-205655, an ink cartridge can be attached to and detached from a printing apparatus body of a printing apparatus. When a small amount of ink remains in the ink cartridge, a user can replace the ink cartridge with a new ink cartridge.

In the related art printing apparatus, an attachment section for the ink cartridge is provided at a front surface side or a side surface side of the printing apparatus body. Depending on which face of the printing apparatus is facing the user, the user may need to specially move from one side to the other side of the printing apparatus to perform attachment and detachment of the cartridge, or may need to change the orientation of the printing apparatus. The user-friendliness of the printing apparatus, thus, is not sufficient for the user. In addition, when a wall or obstacles are present near the front surface side or the side surface side, to which the attachment section is provided, of the printing apparatus body, the user needs to specially change the location of the printing apparatus so that the attachment section is located away from the wall or the obstacles.

SUMMARY

An advantage of an aspect of the invention is that it provides a printing apparatus having high user-friendliness in attachment and detachment of an ink cartridge.

A printing apparatus according to an aspect of the invention includes an ink cartridge that can be attached to and detached from a printing apparatus body, and an attachment section to which the ink cartridge is attached. The ink cartridge can be attached to and detached from the attachment section from a top surface side of the printing apparatus. The "top surface of the printing apparatus" is defined as a surface that is provided at an upper position in the vertical direction of the printing apparatus when the printing apparatus is installed on an installation surface, and is slanted at an angle of equal to or smaller than 45 degrees with respect to the installation surface. The "top surface" may not be flat. The "top surface" may be a curved surface. The "top surface side" is defined as a side on which the top surface is provided with respect to the center of the printing apparatus installed on the installation surface.

With the apparatus of the aspect of the invention, a user can easily reach the attachment section to perform attachment and detachment of the ink cartridge because no obstacles are usually present on the top surface side regardless of which face of the printing apparatus is facing the user. The printing apparatus has high user-friendliness because the user does not need to specially move around the printing apparatus to perform attachment and detachment of the ink cartridge. In addition, the user does not need to specially change the orientation of the printing apparatus. Furthermore, the user does not need to specially change the location of the printing apparatus. The user can perform attachment and detachment of the ink cartridge without changing the orientation and position of the installed printing apparatus, and enjoy convenience.

In this case, the printing apparatus may further include an ejection opening, a first cover, a second cover, and a first restricting unit. The ejection opening is provided on the top surface side of the printing apparatus. A printed printing medium is ejected from the ejection opening. The first cover is provided on the top surface side of the printing apparatus such that it can be opened and closed. The first cover allows the attachment section to be exposed when the first cover is open while the first cover covers the attachment section when the first cover is closed. The second cover is provided on the top surface side of the printing apparatus such that the ejection opening can be opened and closed. The first restricting unit prevents the first cover from being fully opened when the second cover is open. When the second cover is open, the printing apparatus is ready for printing or is performing printing.

The thus-structured printing apparatus can prevent the first cover from being opened and the ink cartridge from being detached while printing is being performed, in addition to the same operation and effect of the printing apparatus according to the aspect of the invention. In other words, performance of an irregular operation while printing is being performed, i.e., a so-called abnormal operation, may be prevented. Consequently, a printing head can be prevented from being broken due to air being taken into the printing head as a result of the detachment of the ink cartridge during printing.

In this case, the printing apparatus may further include an ejection opening, a first cover, a second cover, and a second restricting unit. The ejection opening is provided on the top surface side of the printing apparatus. A printed printing medium is ejected from the ejection opening. The first cover is provided on the top surface side of the printing apparatus such that it can be opened and closed. The first cover allows the attachment section to be exposed when the first cover is open while the first cover covers the attachment section when the first cover is closed. The second cover is provided on the top surface side of the printing apparatus such that the ejection opening can be opened and closed. The second restricting unit prevents the second cover from being fully opened when the first cover is open. When the first cover is open, the printing apparatus is ready for replacement of the ink cartridge.

The thus-structured printing apparatus can prevent printing from being performed during the replacement of the ink cartridge, in addition to the operations and effects of the above-described printing apparatuses. Upon confirming that the second cover is not fully open as a result of the restriction of the second restricting unit, a user does not perform printing. Alternatively, a sensor may be provided that detects the open-closed state of the second cover, and printing may be performed after it is detected that the second cover is fully open. This state structure can more reliably prevent printing from being performed during the replacement of the ink cartridge.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention is described below with reference to the accompanying drawings.

Figure 1:
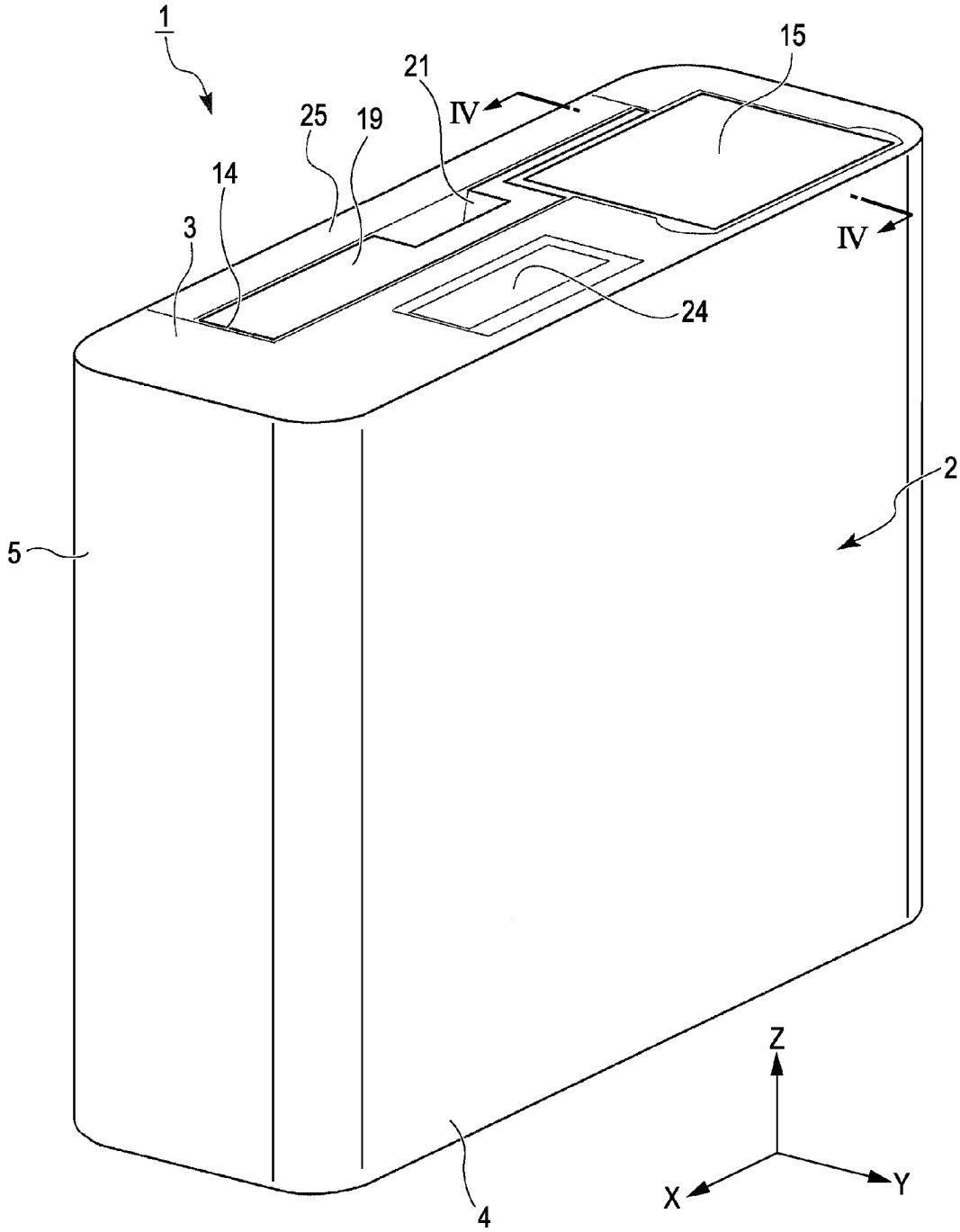
FIG. 1 is a perspective view illustrating a printer of an embodiment.
Figure 2:
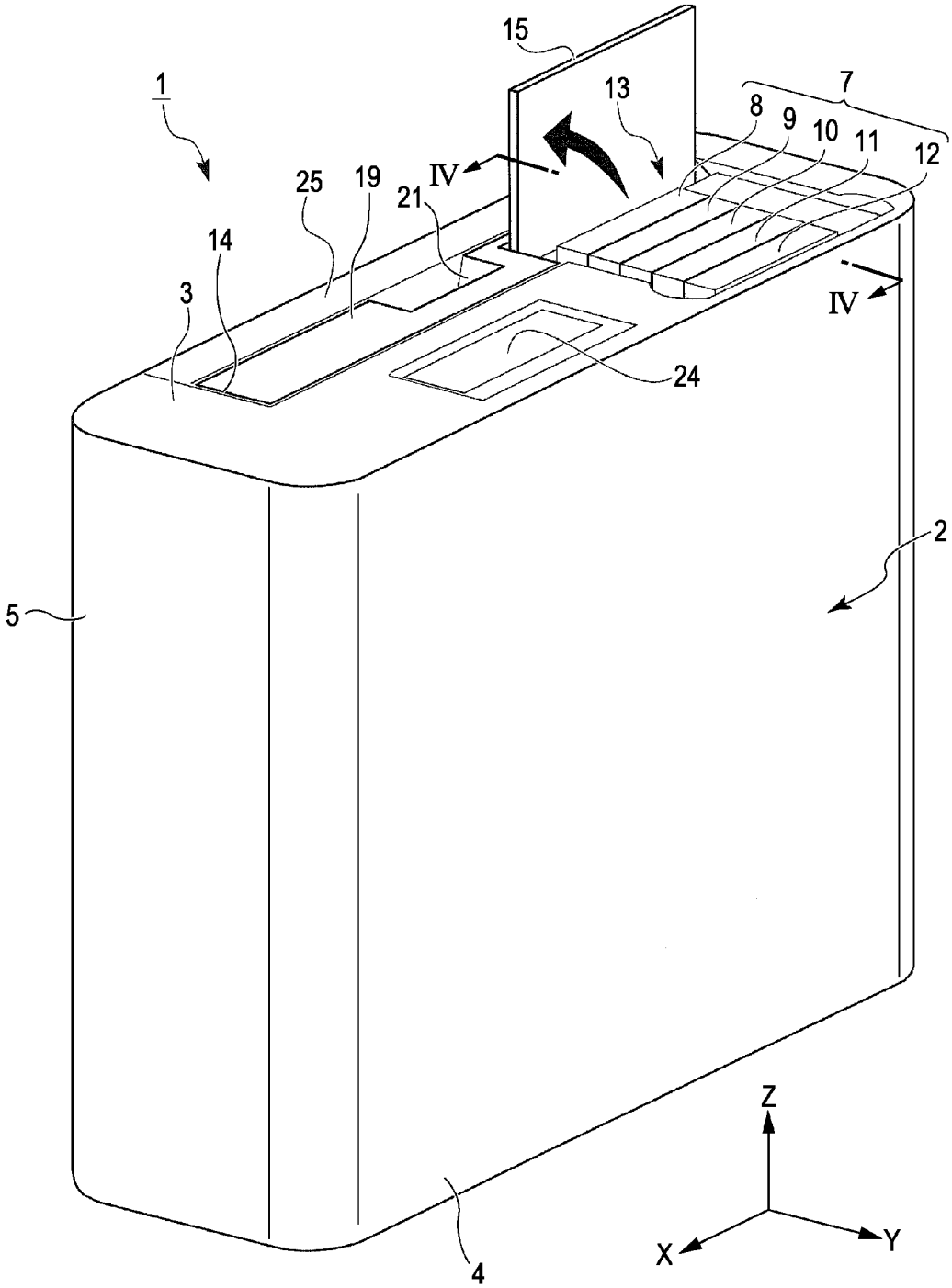
FIG. 2 is a perspective view illustrating the printer of the embodiment during ink cartridge replacement.
Figure 3:
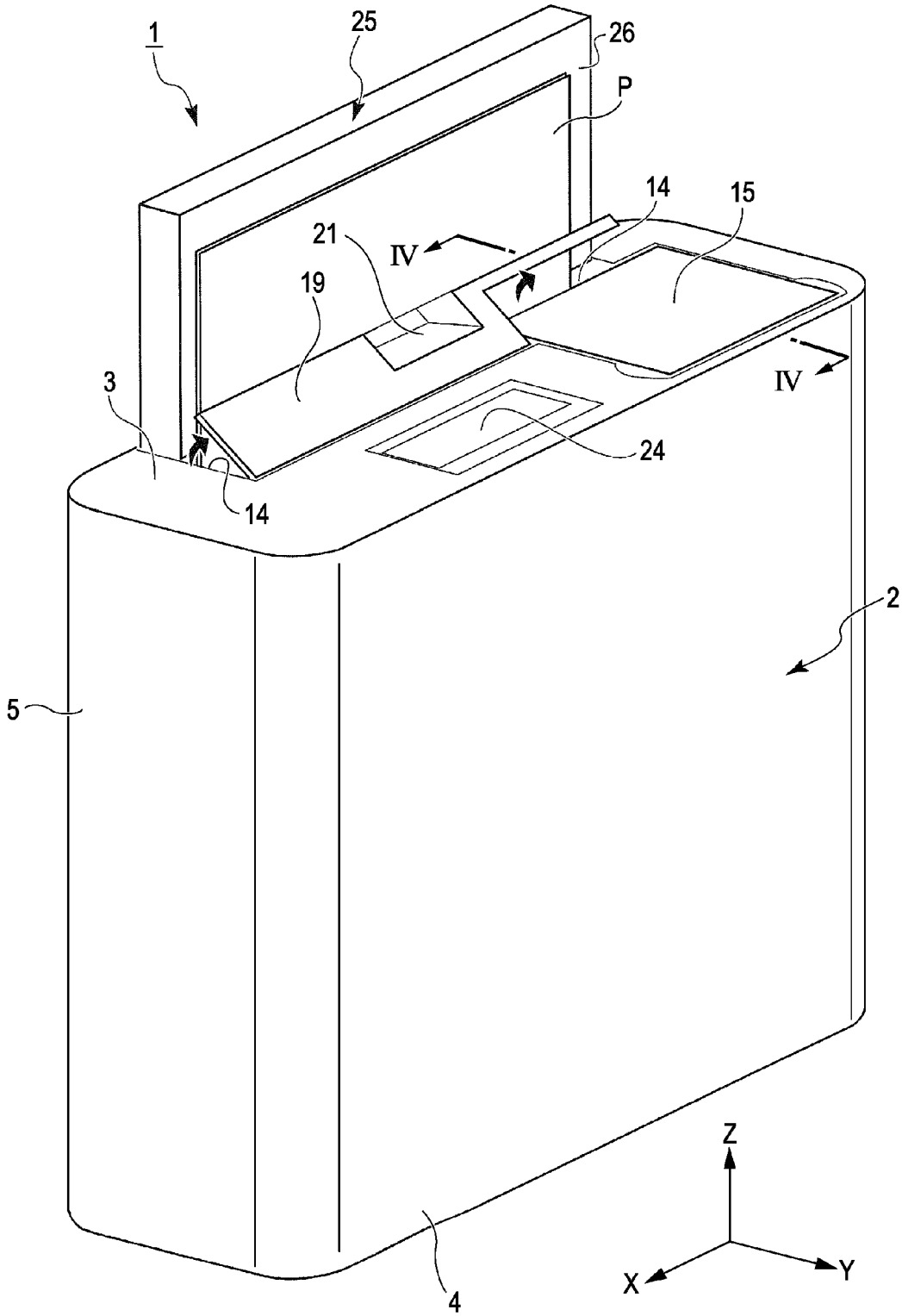
FIG. 3 is a perspective view illustrating the printer of the embodiment during printing.

FIG. 1 is a perspective view illustrating a printer as an example of a printing apparatus according to the invention. FIG. 2 is a perspective view illustrating the printer during ink cartridge replacement. FIG. 3 is a perspective view illustrating the printer during printing. As illustrated in FIGS. 1 to 3, a printer 1 according to the invention is a so-called vertical type printer that is longer in a height direction Z than in a front-back direction Y. An X-axis direction is referred to as a width direction of the printer 1. A Y-axis direction is referred to as a front-back direction of the printer 1. A Z-axis direction is referred to as a height direction of the printer 1.

The printer 1 includes a sheet cassette unit 25, a feeding unit (not illustrated), a printing unit (not illustrated), an ejecting unit (not illustrated), and an operation panel unit 24. The sheet cassette unit 25 can house a bundle of sheets P, and can be attached to and detached from a printer body 2. In addition, the sheet cassette unit 25 can be slid so as to be extended and retracted in the Z-axis direction, which is a feeding direction of the sheet P.

Figure 4A:
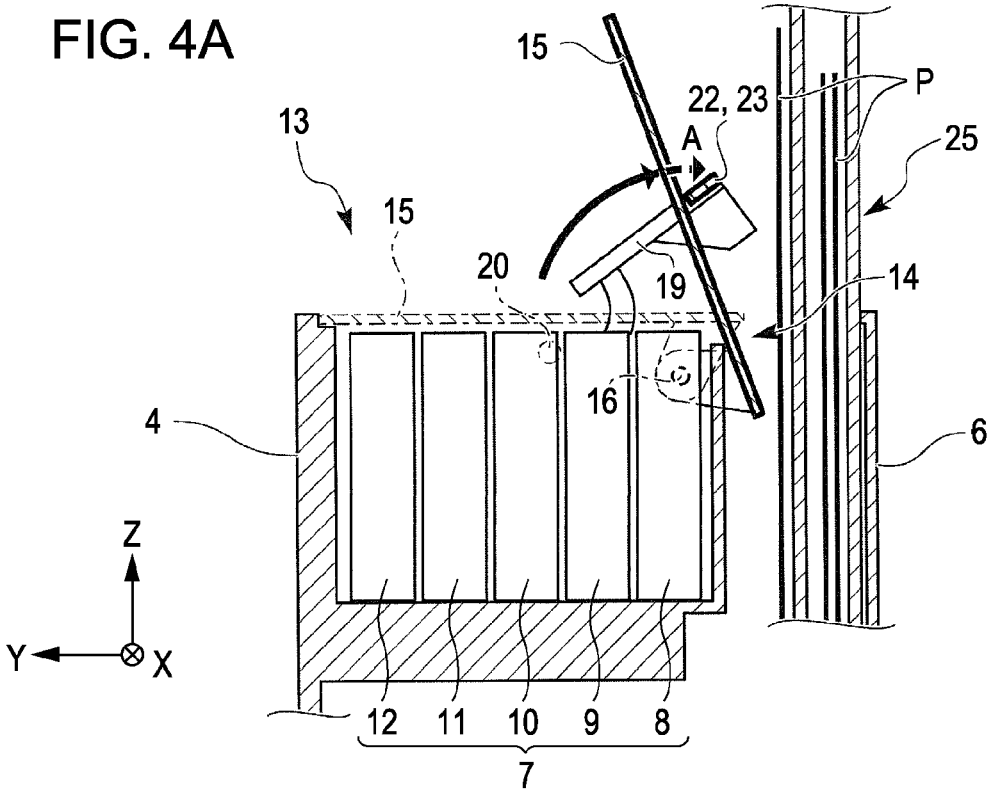
FIGS. 4A and 4B are sectional side views each illustrating a relationship between a first cover and a second cover.
Figure 4B:
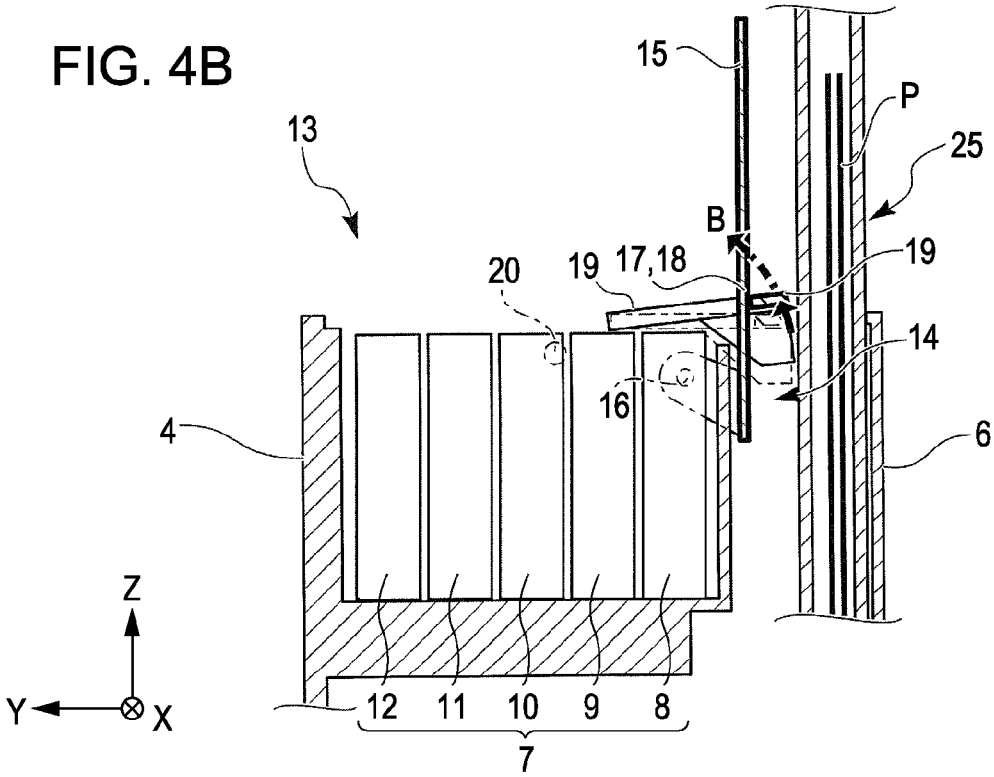

The chassis of the printer body 2 has a front surface 4, side surfaces 5, a top surface 3, and a back surface 6 (refer to FIGS. 4A and 4B). The sheet cassette unit 25 can be attached to and detached from a top surface side of the printer body 2. Hereinafter, the top surface side is defined as a side on which the top surface 3 is provided with respect to the center of the printer body 2. Specifically, the sheet cassette unit 25 is attached to the printer body 2 on the back surface side at the top surface 3.

The feeding unit (not illustrated) feeds the sheet P stacked inside the sheet cassette unit 25 attached to the printer body 2 with rollers and the like. The feeding unit feeds the sheet P along a feeding path formed in a U-shape when viewed from the side surface, first, downward in the Z-axis direction and then upward in the Z-axis direction as a reverse direction. The feeding unit further feeds the sheet P upward in the Z-axis direction to the printing unit, and further to the ejecting unit.

The printing unit (not illustrated) performs printing by ejecting ink onto the sheet P.

The ejecting unit stacks the sheets P after printing as described later in detail.

A user can perform an operation and confirm settings through the operation panel unit 24. The operation panel unit 24 may be structured so as to be operated with buttons or a touch panel. The operation panel unit 24 can also display the settings.

The printer body 2 includes a first cover 15 that can cover the attachment section 13 for the ink cartridge 7, and a second cover 19 with which an ejection opening 14 of the ejecting unit can be opened and closed. The first cover 15 is provided in such a manner that it can be opened and closed. When closed, the first cover 15 can cover the attachment section 13 for the ink cartridge 7 (refer to FIGS. 1 and 3). On the other hand, when open, the first cover 15 allows the attachment section 13 for the ink cartridge 7 to be exposed (refer to FIG. 2).

Accordingly, a user can attach and detach the ink cartridge 7 upon completely opening the first cover 15, i.e., when the first cover 15 is fully open.

In the embodiment, the ink cartridge 7 includes five cartridges, i.e., a first cartridge 8 to a fifth cartridge 12, as an example. The number of ink cartridges included in the ink cartridge 7 depends on the colors and types of ink, such as cyan, magenta, yellow, black for photograph printing, and black for regular printing. Therefore, the number of ink cartridges included in the ink cartridge 7 is not limited to five.

In the embodiment, the ink cartridge 7 can be attached to and detached from the top surface side of the printer 1. Accordingly, a user can easily reach the attachment section 13 for the ink cartridge 7 to easily perform attachment and detachment of the ink cartridge 7 regardless of which side of the printer 1 is facing the user.

Here, supposing that a printer is structured in such a manner that an ink cartridge can be attached to and detached from any one of the front surface, the side surfaces, and the back surface of the printer, a user would need to move to reach the surface for attachment and detachment of the ink cartridge. In addition, if obstacles such as a wall and articles are present near the surface, the user would need to remove the obstacles or change the orientation or the location of the printer.

In contrast, the printer 1 of the embodiment is very user-friendly, because the user can easily reach the attachment section 13 for the ink cartridge 7 from the top surface side of the printer 1. Specifically, the user does not need to move so as to face the desired surface of the printer 1 regardless of which face of the printer 1 is facing the user, and can enjoy convenience. In addition, the user does not need to remove obstacles. Furthermore, the user does not need to change the orientation or the location of the printer 1.

It is sufficient that a structure be adopted in which a user can reach the attachment section 13 from the top surface side of the printer 1 to achieve the operation and effect of user-friendliness in attachment and detachment of the ink cartridge 7. Thus, the first cover 15 may be omitted. In the structure, the attachment section 13 for the ink cartridge 7 can be provided on the top surface side of the printer 1, i.e., in the upper portion of the printer 1. As a result, ink in the ink cartridge 7 can be easily supplied to the printing unit located below the ink cartridge 7 with a so-called head.

The second cover 19 is provided in such a manner that the ejection opening 14 can be opened and closed (refer to FIGS. 1 to 3). The opening-closing operation of the second cover 19 may be performed by an opening-closing unit (not illustrated) provided inside the printer 1. The opening-closing unit is actuated after receiving a printing start command, for example.

The second cover 19 has a notched section 21 at a side adjacent to the sheet cassette unit 25. By using the notched section 21, a user can pull the sheet cassette unit 25 attached to the printer body 2 as illustrated in FIG. 1 upward in the z-axis direction and detach the sheet cassette unit 25. The user can slide and extend the sheet cassette unit 25 by an amount corresponding to the size of sheet P, and set the sheet P inside the sheet cassette unit 25. An edge guide (not illustrated) is provided inside the sheet cassette unit 25, and the position of the edge guide is changed in accordance with the size of the sheet P. When the sheet cassette unit 25 in the extended state is set again to be inside the printer body 2, an upper portion of the sheet cassette unit 25 in the Z-axis direction projects upward in the z-axis direction from the top surface 3 of the printer body 2 (refer to FIG. 3).

Thereafter, the opening-closing unit (not illustrated) is actuated after receiving the printing start command, and pushes the second cover 19 from the inside of the printer body 2 to open the second cover 19 (refer to FIG. 3).

The second cover 19 may be opened to the extent that the sheet P can be ejected from the ejection opening 14. A surface 26 at a side adjacent to the second cover 19 of the sheet cassette unit 25 functions as a stacker surface 26 on which the ejected sheets P are stacked.

As illustrated in FIG. 3, the ejected sheets P are stacked on the stacker surface 26 in the Y-axis direction.

The second cover 19 illustrated in FIG. 3 is fully open (in the fully open state). A sensor (not illustrated) is provided to detect that the second cover 19 is fully open. In addition, a controller (not illustrated) determines that the second cover 19 is fully open, and thereafter controls the printing unit (not illustrated) to actually start printing.

A relationship between the first cover 15 and the second cover 19 is described below in detail.

FIGS. 4A and 4B are sectional side views each illustrating the relationship between the first cover 15 and the second cover 19. Each sectional side view is taken along the line IV-IV of FIGS. 1 to 3. FIG. 4A illustrates a state in which the second cover 19 is fully open while the first cover 15 is being opened from the closed state. On the other hand, FIG. 4B illustrates a state in which the first cover 15 is fully open while the second cover 19 is being opened from the closed state.

As illustrated in FIG. 4A, the first cover 15 is provided in such a manner that it swings around a first swing axis 16 acting as a center. Likewise, the second cover 19 is provided in such a manner that it swings around a second swing axis 20 acting as a center. As illustrated in FIG. 4A, the second cover 19 is fully open during printing.

During printing, if the ink cartridge 7 is detached or comes off for some reason, ink cannot be supplied to the printing unit. In the worst case, nozzles (not illustrated) of a printing head (not illustrated) of the printing unit may be broken due to air taken into a supply flow path.

In order to prevent the occurrence of such a problem, the printer 1 of the embodiment includes a first restricting unit 23 that limits the swing of the first cover 15 to be opened such that the first cover 15 is not fully opened when the second cover 19 is fully open. As an example of the first restricting unit 23, a first restrictor 22 is provided as a part of the second cover 19 that is fully open such that it is located on a moving path A along which the first cover 15 moves from closed state to fully open state. The first restrictor 22 can limit the swing of the first cover 15 to be opened before the first cover 15 is fully opened.

As a result, the ink cartridge 7 can be prevented from being detached or coming off for some reason.

In FIG. 4A, the first cover 15 is positioned just above the first cartridge 8 and the second cartridge 9, and not positioned above the third cartridge 10 to the fifth cartridge 12. The first cover 15 is preferably positioned just above all of the first cartridge 8 to the fifth cartridge 12. In other words, the movement of the first cover 15 is preferably limited when the first cover 15 makes a small opening angle with respect to the closed state. This limitation can prevent all of the first cartridge 8 to the fifth cartridge 12 from being detached.

In the embodiment, the first cartridge 8 to the fifth cartridge 12 are arranged along the Y-axis direction. Alternatively, the first cartridge 8 to the fifth cartridge 12 may be arranged along the X-axis direction. In such a case, all of the first cartridge 8 to the fifth cartridge 12 can be prevented from being detached because the first cover 15 is positioned just above part of each of the first cartridge 8 to the fifth cartridge 12. In other words, the arrangement of the cartridges along the axis direction of the first swing axis 16 can prevent all of the first cartridge 8 to the fifth cartridge 12 from being detached even when the first cover 15 makes a certain large opening angle with respect to the closed state.

When fully open, the second cover 19 is held by, for example, the opening-closing unit (not illustrated) to keep its posture. The structure prevents a user who is opening the first cover 15 from closing the second cover 19. In this way, the first restricting unit 23 can reliably limit the swing of the first cover 15 to be opened.

In the embodiment, the first restrictor 22, which is a part of the second cover 19, is employed as an example of the first restricting unit 23. The first restrictor 22, however, is not limited to being formed as a part of the second cover 19. Another member may be provided to the second cover 19 instead of using a part of the second cover 19.

As illustrated in FIG. 4B, the first cover 15 is fully open during replacement of the ink cartridge 7.

During replacement, if printing starts, ink may not be supplied to the printing unit because the ink cartridge 7 has been detached. In the worst case, the nozzles (not illustrated) of the printing head (not illustrated) of the printing unit may be broken due to air being taken into the supply flow path.

In order to prevent the occurrence of such a problem, the printer 1 of the embodiment includes a second restricting unit 18 that limits the swing of the second cover 19 to be opened such that the second cover 19 is not fully opened when the first cover 15 is fully open. As an example of the second restricting unit 18, a second restrictor 17 is provided as a part of the first cover 15, which is fully open, such that it is located on a moving path B along which the second cover 19 moves from closed state to fully opened state.

The second restrictor 17 can limit the swing of the second cover 19 to be opened before the second cover 19 is fully opened. During the swing of the second cover 19 before being limited, even when receiving a printing start command, the controller (not illustrated) determines that the second cover 19 is not yet fully open and controls the printing unit so as not to start printing. As a result, the nozzles (not illustrated) of the printing head can be prevented from being broken.

As an example of a posture keeping unit of the first cover 15, one of a protrusion and a recess is formed on the first cover 15 and the other one is formed on the printer body 2. When the first cover 15 is fully opened, the protrusion engages with the recess to keep the posture of the first cover 15. The engagement prevents the opening-closing unit of the second cover 19 from closing the first cover 15. In this way, the second restricting unit 18 can reliably limit the swing of the second cover 19 to be opened.

In the embodiment, the second restrictor 17, which is a part of the first cover 15, is employed as an example of the second restricting unit 18. The second restrictor 17, however, is not limited to being formed as a part of the first cover 15. Another member may be provided to the first cover 15 instead of using a part of the first cover 15. In the embodiment, the first swing axis 16 and the second swing axis 20 are arranged such that both axis directions are parallel with the X-axis direction. The arrangement, however, is not limited to this case. Any one of the axis directions may be parallel with the Y-axis direction. Even in such a case, the first restricting unit 23 and the second restricting unit 18 can be structured. In the embodiment, the first cover 15 and the second cover 19 are provided on the same plane, i.e., the top surface 3. The first cover 15 and the second cover 19, however, are not limited to being provided on the same plane.

The printer 1 serving as the printing apparatus of the embodiment includes the ink cartridge 7 that can be attached to and detached from the printer body 2 serving as the printing apparatus body, and the attachment section 13 to which the ink cartridge 7 is attached. The ink cartridge 7 can be attached to and detached from the attachment section 13 from the top surface side of the printer 1.

The printer 1 of the embodiment further includes the ejection opening 14, the first cover 15, the second cover 19, and the first restricting unit 23. The ejection opening 14 is provided on the top surface side of the printer 1. A printed sheet, which is an example of a printing medium to be printed, is ejected from the ejection opening 14. The first cover 15 is provided on the top surface side of the printer 1 such that it can be opened and closed. The first cover 15 allows the attachment section 13 to be exposed when the first cover 15 is open while the first cover 15 covers the attachment section 13 when the first cover 15 is closed. The second cover 19 is provided on the top surface side of the printer 1 such that the ejection opening 14 can be opened and closed. The first restricting unit 23 prevents the first cover 15 from being fully opened when the second cover 19 is open.

The printer 1 of the embodiment further includes the ejection opening 14, the first cover 15, the second cover 19, and the second restricting unit 18. The ejection opening 14 is provided on the top surface side of the printer 1. A printed sheet is ejected from the ejection opening 14. The first cover 15 is provided on the top surface side of the printer 1 such that it can be opened and closed. The first cover 15 allows the attachment section 13 to be exposed when the first cover 15 is open while the first cover 15 covers the attachment section 13 when the first cover 15 is closed. The second cover 19 is provided on the top surface side of the printer 1 such that the ejection opening 14 can be opened and closed. The second restricting unit 18 prevents the second cover 19 from being fully opened when the first cover 15 is open.

Another Embodiment

Figure 5B:
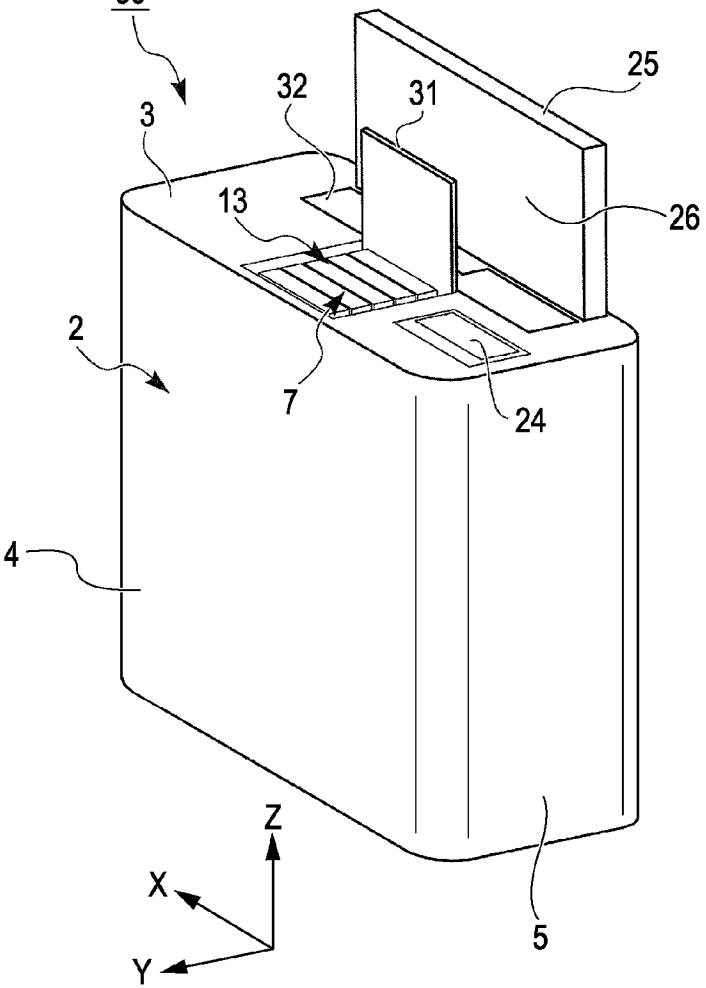
FIGS. 5A and 5B are perspective views illustrating a printer of another embodiment.
Figure 5A:
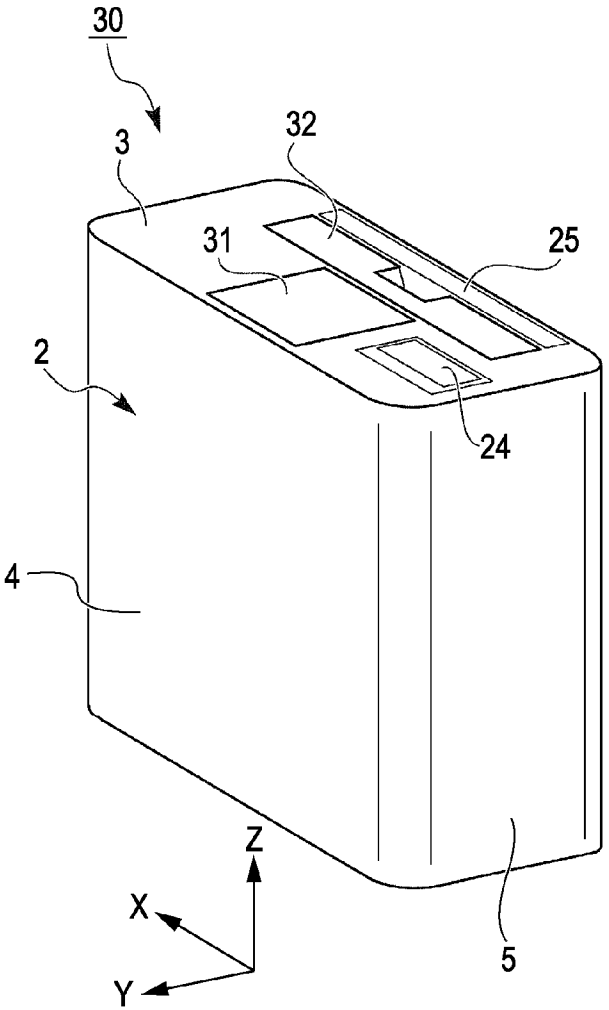

FIGS. 5A and 5B are perspective views illustrating a printer of another embodiment. FIG. 5A illustrates the printer when a first cover and a second cover are closed. On the other hand, FIG. 5B illustrates the printer when the first cover is open and a sheet cassette unit is set in an extended state.

As illustrated in FIGS. 5A and 5B, a printer 30 of this embodiment includes a first cover 31 and a second cover 32.

The other elements are the same as those of the above-described embodiment and labeled with the same numerals. The description thereof is thus omitted.

The first cover 31 covers the attachment section 13 for the ink cartridge 7 in the same manner as the first cover 15 of the above-described embodiment (refer to FIGS. 1 to 4B). The first cover 31, however, differs from the first cover 15 in that it is disposed at nearly the center in the width direction X on the top surface 3. The second cover 32 covers the ejection opening 14 in the same manner as the second cover 19 of the above-described embodiment (refer to FIGS. 1 to 4B).

In this embodiment, the first cover 31, i.e., the attachment section 13 for the ink cartridge 7, is disposed at nearly the center in the width direction X on the top surface 3. In other words, the first cover 31 is not eccentrically disposed. This location allows a user to more easily reach the attachment section 13 for the ink cartridge 7. As a result, the user-friendliness of the printer 30 is further increased.

In the embodiment, the attachment section 13 for the ink cartridge 7 is disposed somewhat toward the front side from the center in the front-back direction Y, because the sheet cassette unit 25 is disposed on the back side and is set such that it projects upward in the Z-axis direction from the top surface 3. However, the attachment section 13 for the ink cartridge 7 is also preferably disposed at nearly the center in the front-back direction Y on the top surface 3. This location allows the user to easily reach the attachment section 13 regardless of which face of the printer 30 is facing the user.

In both embodiments, the side surfaces having large areas out of the four side surfaces are defined as the front surface 4 and the back surface 6. The front and back surfaces are not limited to the side surfaces having the large areas. The side surface 5 having a small area may be defined as the front surface.

It is understood that the invention is not limited to the above-described embodiments, and can be modified without departing from the scope of the invention and claims. The appended claims are intended to be construed to include all such embodiments and equivalent variations.

The entire disclosure of Japanese Patent Application No: 2010-210520, filed Sep. 21, 2010 is expressly incorporated by reference herein.

What is claimed is:

1. A printing apparatus, comprising:

a printing apparatus body that is a vertical installation type body having a height direction dimension that is larger than at least one of a width direction dimension and a length direction dimension when the printing apparatus is installed;

an ink cartridge that is attachable to and detachable from the printing apparatus body;

an attachment section to which the ink cartridge is attached;

an ejection opening that is disposed on a top surface side of the printing apparatus, and from which a printed printing medium is ejected;

a first cover that is provided on the top face side of the printing apparatus such that the first cover is capable of being opened and closed, covers the attachment section when the first cover is closed, and allows the attachment section to be exposed when the first cover is open; and a second cover that is provided on the top surface side of the printing apparatus, and allows the ejection opening to be opened and closed;

wherein the ink cartridge is attachable to and detachable from the attachment section from the top surface side of the printing apparatus.

2. The printing apparatus according to claim 1, further comprising a first restrictor that prevents the first cover from being fully opened when the second cover is open.

3. The printing apparatus according to claim 2, wherein the first restrictor is a part of the second cover that projects into an opening-closing movement path of the first cover.

4. The printing apparatus according to claim 1, further comprising a second restrictor that prevents the second cover from being fully opened when the first cover is open.

5. The printing apparatus according to claim 4, wherein the second restrictor is a part of the first cover that projects into an opening-closing movement path of the second cover.

* * * * *